United States Patent [19]

Nakagawa et al.

[11] 4,419,072

[45] Dec. 6, 1983

[54] HANDY TORCH

[75] Inventors: Katsuyuki Nakagawa, Osaka; Naoki Oda, Ashiya, both of Japan

[73] Assignee: Sankin Industry Co., Ltd., Osaka, Japan

[21] Appl. No.: 356,902

[22] Filed: Mar. 10, 1982

[51] Int. Cl.[3] ..... F23Q 3/00

[52] U.S. Cl. ..... 431/266; 431/255; 431/344; 431/355

[58] Field of Search ..... 431/255, 264, 266, 344, 431/354, 355

[56] References Cited

U.S. PATENT DOCUMENTS 3,603,710 9/1971 Riverson ..... 431/255
3,756,767 9/1973 Ishiguro ..... 431/255

FOREIGN PATENT DOCUMENTS 54-26539 2/1979 Japan .

OTHER PUBLICATIONS

"Sidewinder" Model ST-1 Advertisement
"Torch Lamp" Advertisement
"Formadent" Brochure

*Primary Examiner*—Carroll B. Dority, Jr.
*Attorney, Agent, or Firm*—Kenway & Jenney

[57] ABSTRACT

A handy torch comprises a tank, a first valve mechanism, a second valve mechanism, a burner having a nozzle and an air-intake opening. A pipe connects the second valve mechanism with the burner. The first valve mechanism includes a first valve body having a cylindrical inner wall with a female thread and a valve seat, an actuating member having a male thread screwed with the female thread of the first valve body, a disc, a resilient O-ring disposed between the valve seat and the disc. The O-ring is designed such that the gas flowing from an entrance of the first valve mechanism can be controlled by the O-ring in cooperation with the disc and the valve seat. A suction material connects the male thread of the actuating member with the gas in the tank. The second valve mechanism includes a second valve body having a passage and a through-hole with a female thread, and a needle having a male thread screwed with the female thread of the second valve body for controlling the gas flowing through the passage. A gas adjusting dial member is fixed to the needle. The torch comprises further a piezo-electric unit having an ignition button, an air adjuster and an air control lever. A casing houses therein at least partly the tank and others and has a gripped portion. The gas adjusting dial member, the air control lever and the ignition button are arranged near the gripped portion. The nozzle is inclined outwardly at an angle of 30–75 degree in respect to the longitudinal direction of the torch.

8 Claims, 6 Drawing Figures

HANDY TORCH

BACKGROUND OF THE INVENTION

This invention relates to a handy torch for multipurpose.

Various types of handy torch lamps have been proposed and developed. One prior art torch is of pistol type. Another conventional torch is that a torch body must be always placed on a desk or the like when it is used. The flame is oriented only in a vertical direction. Still another conventional torch is that the flame is oriented merely in a horizontal direction.

SUMMARY OF THE INVENTION

According to this invention, a handy torch comprises a tank for containing butane gas therein, a first valve mechanism fixed to the tank, a second valve mechanism connected to the first valve mechanism, a burner having a nozzle at its tip portion and an air-intake opening at its intermediate portion where air is mixed with the gas coming from the second valve mechanism. A pipe connects the second valve mechanism with the burner.

The first valve mechanism includes a first valve body having a cylindrical inner wall, a female thread formed in the cylindrical inner wall and a valve seat formed in the first valve body, an actuating member having a male thread which is screwed with the female thread of the first valve body with a small gap for gas flow, a disc positioned downstream of the male thread of the actuating member and movable along the cylindrical inner wall in the first valve body in its longitudinal direction with a small gap between the periphery of the disc and the cylindrical inner wall of the first valve body so that the gas can flow through the gap, and a resilient O-ring disposed between the valve seat and the disc and positioned downstream of the disc.

The O-ring is designed such that the gas flowing from an entrance of the first valve mechanism to an exit thereof can be controlled by the O-ring in cooperation with the disc and the valve seat. The actuating member has a driven portion so that the actuating member can be turned in a desired direction when the driven portion is driven.

A suction material is arranged through the entrance of the first valve mechanism to connect the male thread of the actuating member with the gas contained in the tank.

The second valve mechanism includes a second valve body having therein a passage formed from an entrance of the second valve mechanism connected with the exit of the first valve mechanism to an exit of the second valve mechanism connected with the pipe. The second valve mechanism also includes a through-hole formed with a female thread, and a needle having at its intermediate portion a male thread screwed with the female thread of the second valve body for controlling the gas flowing through the passage.

A gas adjusting dial member is fixed to the needle so that the needle can be turned to move forwards or backwards when the gas adjusting dial member is turned.

The torch comprises further means for regulating air to be introduced into the air-intake opening and an air control lever for actuating the regulating means.

A support base supports the burner, the air control lever and a piezo-electric unit having an ignition button.

An ignition plug is placed near the nozzle and electrically connected to the piezo-electric unit.

A casing houses therein at least partly the tank, the first valve mechanism, the second valve mechanism, the pipe, the piezo-electric unit, the burner and the air control lever, and has a gripped portion adapted to be gripped by hands. The gas adjusting dial member, the air control lever and the ignition button are arranged near the gripped portion of the casing.

The nozzle is inclined outwardly at an angle between 30 degree and 75 degree.

The size and sharpness of flame can be controlled freely and easily. It enables to secure superior efficiency in either case of using on desks or holding by hands. The flame can be oriented in many directions.

Because butane gas for a gas-lighter in commercial markets can be used as the gas to be filled, filling operation is very easy and convenient.

The torch can be used for the extensive ranges of various user's works. The torch is most suitable for melting, casting, welding, soldering and waxing works in different fields. For example, the torch can be used in dental and other medical treatments. Also, it can be used as spectacles and optical instruments. Further, it is useful for handiworks such as glassware, chasing, experiments in schools, laboratories, repairs of precision instruments or maintenances.

The torch according to this invention can be used in various conditions or states. When the torch is afraid of being clogged in its nozzle portion in some wax works, for example, the torch is preferably placed its side up to avoid the clogging.

DETAILED DESCRIPTION OF A PREFERRED EMBODIMENT

Figure 1:
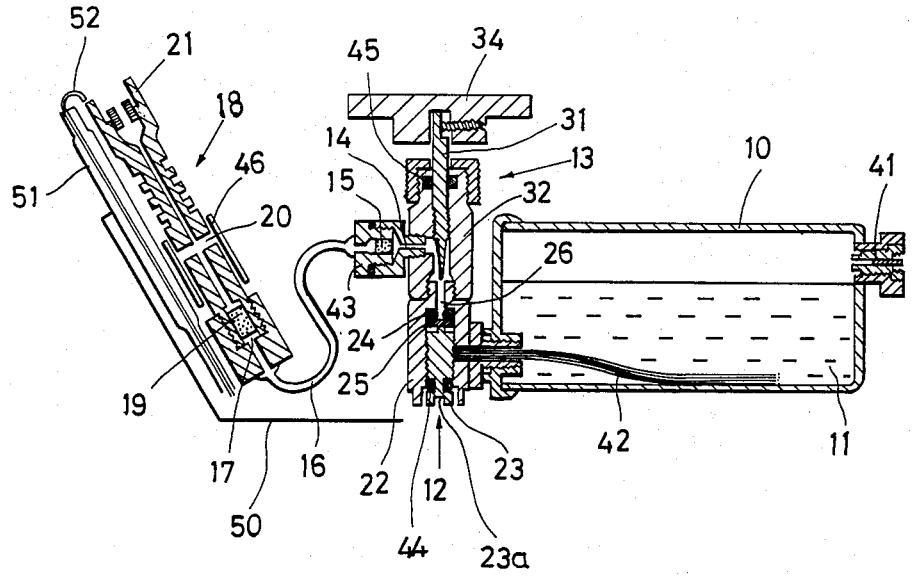
FIG. 1 is an elevational sectional view showing an essential portion of a handy torch according to this invention.
Figure 2:
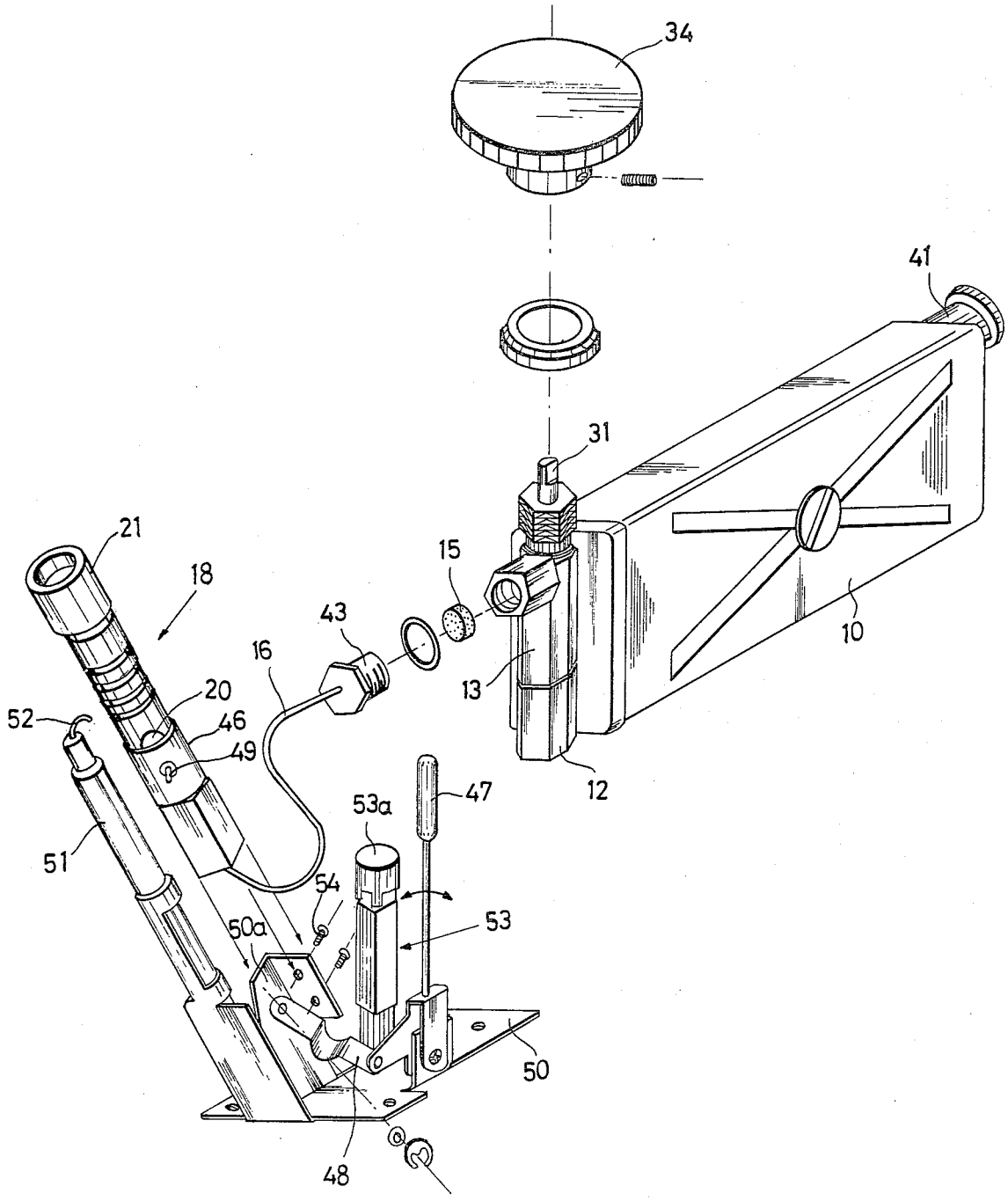
FIG. 2 is a disassembled view of the handy torch shown in FIG. 1.

Referring now to FIGS. 1 and 2, a tank 10 contains therein butane gas 11 in a liquefied state. The gas may be one for a gas-lighter in commercial markets.

A first valve mechanism 12 is joined to one side portion of the tank 10. A second valve mechanism 13 is joined to the first valve mechanism 14. The second valve mechanism 13 is connected by way of a through hole 14, filter 15 and pipe 16 to a burner 18. The burner 18 has a chamber 17, filter 19, air-intake passage 20 and nozzle 21. A flame is produced from the nozzle 21.

The first valve mechanism 12 includes a valve body 22, an actuating member 23, a cylindrical inner wall formed in the valve body 22, an O-ring 24, and a disc 25. The disc 25 is movably placed within the inner wall in its longitudinal direction. A valve seat is formed in the valve body 22 at the upper end of the cylindrical inner wall in FIG. 1. The O-ring 24 is disposed between the disc 25 and the valve seat.

The disc 25 is made of a rigid material such as a metal. There is a gap between the outer periphery of the disc 25 and the inner wall of the valve body 22. For example, the gap ranges between 0.01 mm and 0.1 mm.

A female thread is formed in the cylindrical inner wall of the valve body 22. A male thread formed in the outer surface of the actuating member 23 is screwed with the female thread of the valve body 22. There is a small gap between the male thread of the actuating member 23 and the female thread of the valve body 22 so that the butane gas can flow therethrough.

A well-known liquid suction material 42 is inserted at its one end into the butane gas 11 in the tank 10 and contacts at its other end the male thread of the actuating member 23 so that the gas can come from the tank 10 to the actuating member 23 within the first valve body 22.

Another O-ring 44 is disposed between the actuating member 23 and the valve body 22 to prevent the gas from flowing out of the first valve mechanism 12 for the sealing purpose.

A small through-hole 26 is formed downstream of the valve seat in the axis direction of the cylindrical inner wall of the valve body 22 at the exit thereof. The first valve mechanism 12 is connected through this through-hole 26 to the inlet of the second valve mechanism 13.

The O-ring 24 is preferably of such a size and material that it can function in two different ways: In one way, the O-ring 24 functions merely to seal when the pressure in the tank 10 is not enough higher than that in the burner 18, and in the other way, it functions to regulate or control the gas flow (but not to completely seal) when the pressure in the tank 10 is enough higher than that in the burner 18.

For the best results, the O-ring 24 is made of a nitrile rubber. Its hardness is preferably between 40 and 50 of Shore A. Although it may be more than 70 of Shore A under some circumstances, it is apt to be too hard to control precisely the gas flow. As a fluorine rubber has a poor resilient characteristic as compared with the nitrile rubber, it is difficult to control the gas flow if such a fluorine rubber is used. A silicone rubber may be used from the viewpoint of its elasticity or resiliency only. The silicone rubber should preferably have Shore hardness of 40–60.

The actuating member 23 has at its lower end a groove 23*a*. For instance, a well known driver can be inserted into the groove 23*a* and turn the actuating member to the left or right to make the flame larger or smaller to thereby get a desired moderate flame.

The amount of gas flow over the O-ring 24 changes depending upon a material or hardness of the O-ring.

The gas flow can be controlled by adjusting the distance beween the disc 25 and the valve seat in the valve body 22 so that the degree of deforming the O-ring 15 can be adjusted.

The ordinary O-ring 44 functions only to seal. The hardness of the O-ring 44 preferably ranges between 60 and 70 of Shore A.

The second valve mechanism 13 is of a needle type. A valve body 32 is formed with a L-shaped passage therein connected at one end to the through-hole 26 of the first valve mechanism 12 and at the other end to the pipe 16. A needle 31 is set in the second valve mechanism 13. The tip of the needle 31 faces the upper end of the through-hole 26 of the first valve mechanism 12. The needle 31 has a male thread at its intermediate portion which is screwed with a female thread formed in the valve body 32 in its longitudinal direction. A gas adjusting dial member 34 is fixed to the upper end of the needle 31 by a screw. A conventional O-ring 45 is disposed between the needle 31 and the valve body 32 to prevent the gas from flowing out of the second valve mechanism 13.

The filter 15 is retained in a mixer joint 43. The pipe 16 is connected through the mixer joint 43 to the outlet of the second valve mechanism 13.

A ring-shaped air adjuster 46 is movably arranged along the burner 18 in cooperation with the air intake opening 20. An air control lever 47 is connected by way of a linkage 48 to the air adjuster 46 so as to move the air adjuster 46 thereby to regulate the opening degree of the air opening 20. The linkage 48 is joined to the air adjuster 46 by means of a pin 49. The air control lever 47 is supported by a support base 50.

Figure 4:
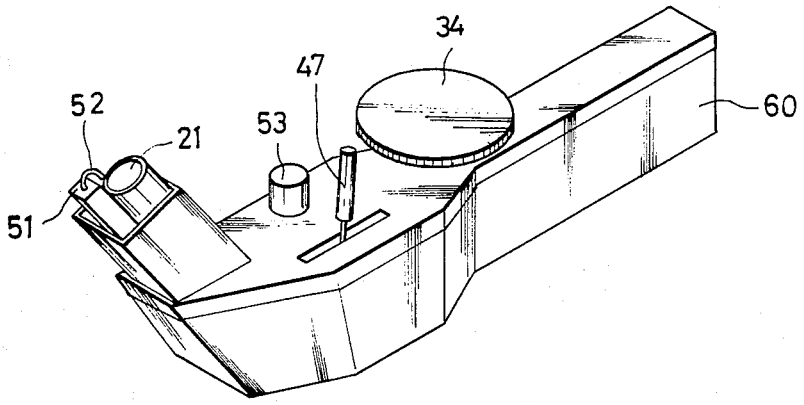
FIG. 4 is a perspective view of the handy torch.

The support base 50 also supports the burner 18, a ceramic tube 51 holding an ignition plug 52 therein and a piezo-electric unit 53 having a pushing type ignition button 53*a*. The piezo-electric unit 53 is electrically connected to the ignition plug 52. The burner 18 is fixed to a raising portion 50*a* of the base 50 by means of screws 54. As best shown in FIG. 1, the nozzle 21 is inclined at an angle of 30–75 degree in respect of the longitudinal direction of the torch. For instance, when the torch is placed on a horizontal upper surface of a desk as shown in FIG. 4, the inclined angle of the burner 18 ranges between 30 degree and 75 degree in respect of the horizontal surface.

The tank 10 is equiped with a valve 41 for filling the butane gas which may be anyone for gas-lighter in commercial markets.

A casing 60 houses the tank 10, the first and second valve mechanisms 12, 13, the pipe 16, the support base 50 and others except the tip portions of the burner 18, ceramic tube 51, plug 52, lever 47, pushing type ignition button 53*a*, the gas adjusting dial member 34 and the filling valve 41 as shown in FIGS. 3 to 6. The outer end of the actuating member 23 having the groove 23*a* is also exposed.

Figure 3:
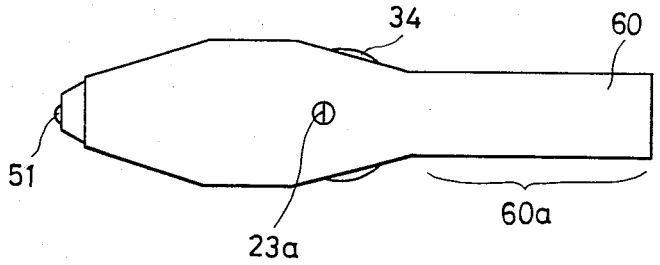
FIG. 3 is a bottom view of the handy torch shown in FIG. 1.
Figure 5:
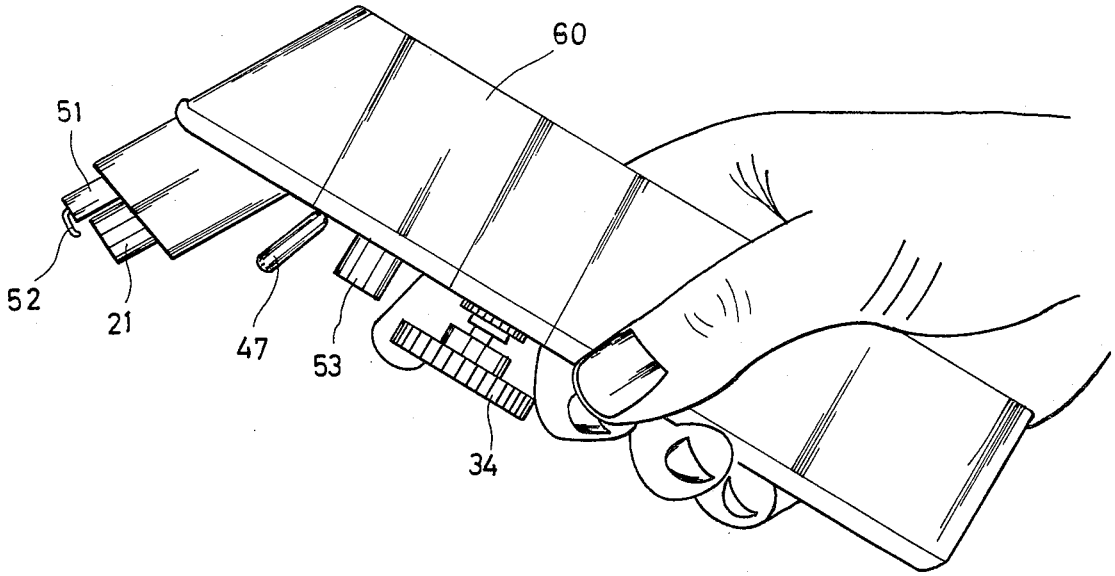
FIG. 5 shows a condition in which the handy torch is used in dental treatments.

The casing 60 is formed with a portion 60*a* adapted to be gripped by hands as shown in FIGS. 3 and 5. The air adjusting lever 47, the pushing type ignition button 53*a* and the gas adjusting dial member 34 are arranged the gripped portion 60*a* so that they can be operated by fingers while the torch is gripped by a hand. In such a case, the other hand is completely free.

Figure 6:
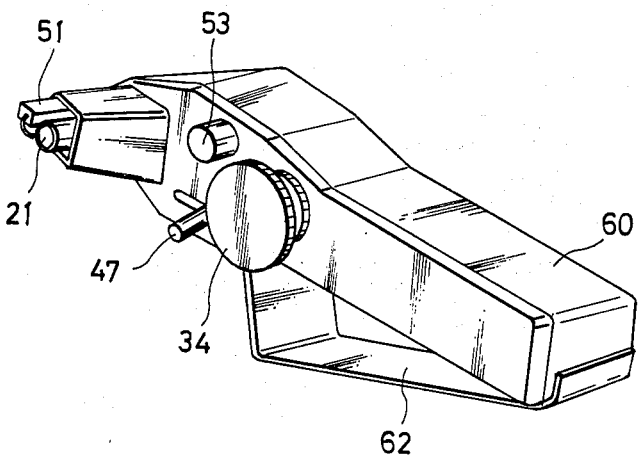
FIG. 6 shows another condition in which the handy torch is used.

Also, the casing 60 is formed such that a flame can be oriented in various directions. For instance, FIG. 4 shows a condition in which the torch is put on a desk or the like. In this condition, the bottom of the casing 60 contacts the desk. FIG. 5 shows, for example, that the torch is applied to dental treatments. FIG. 6 shows a condition in which the torch is set on a L-shaped holder 62. In this condition, a side portion of the casing 60 contacts the holder 62 so that the flame goes in a horizontal direction.

The operation of the torch as above-stated will be described.

Prior to the gas filling, the gas adjusting dial member 34 is closed tightly. Thereafter, butane for a gas-lighter on the market is filled through the gas inlet of the filling valve 41 in the same way as an ordinary gas-lighter. For instance, the maximum amount of gas to be filled is 27 c.c. or 17.3 g, which can be used for 1.5 to 4 hours continuously, depending upon the flame size.

For the ignition purpose, the air adjusting lever 47 is set at the air-flow lowest position. Thereafter the gas adjusting dial member 34 is gently turned to the open direction about one round. After a hissing sound which is a gas jetting sound is made sure, the ignition button 53*a* is pushed in the same way as a lighter.

After ignited, the air adjusting lever 47 is turned to the air-flow highest position. If desired, by turning gently the gas adjusting dial member 34 more or opposite to the open direction to obtain a proper flame.

When such a proper flame cannot be obtained by stepping the above procedures, the actuating member 23 of the first valve mechanism 12 is gradually turned, for instance, by using a driver. In order to make the flame larger, it is turned to the left. On the contrary, it is turned to the right so as to make the flame smaller. In particular, when temperature has changed largely, the actuating member 23 should be adjusted because the amount of jetting gas is varied. In general, higher temperature accelerates evaporation of LP-gas and lower temperature retards the evaporation.

The first valve mechanism 12 functions as follows:

When the O-ring 24 is not so pressed by the disc 25, the gas flows by way of the liquid suction material 42 to the first valve mechanism 12. The gas flows between the male and female threads to the O-ring 24. As a result, the gas pressure increases upstream of the O-ring 24. This causes the O-ring 24 to slightly deform at its portion which contacts the disc 25 and/or the valve seat so that the gas can flow over the O-ring 24. The gas which has passed the O-ring 24 is vaporized in a space downstream of the O-ring 24.

Unless the gas pressure in the tank 10 becomes enough higher than that in the burner 18, the gas cannot flow over the O-ring 24 because the O-ring 24 functions only to seal. Only when the gas pressure in the tank 10 becomes enough higher than that in the burner 18, the O-ring 24 slightly deforms at its contact portion to form a small gap between the O-ring 24 and the disc 25 and/or the valve seat. If the gas pressure in the tank 10 suddenly increases due to some accident, a large amount of gas rapidly flows to the disc 25 and the O-ring 24. It urges the disc 24 to move toward the valve seat so that the O-ring 24 is pressed against the valve seat. Thus, the sealing effect of the O-ring 24 increases. It means that the gas flow over the O-ring 24 is regulated. Accordingly, the gas can be prevented from flowing over the O-ring 24 too much without vaporization. In other words, the liquid gas does not remain downstream of the O-ring 24.

Although one embodiment of this invention has been disclosed and described, it is apparent that other embodiments and modifications of this invention are possible.

What is claimed is:

1. A handy torch comprising:

a tank (10) for containing fuel gas (11) therein in a liquefied state;

a first valve mechanism (12) fixed to the tank (10);

a second valve mechanism (13) connected to the first valve mechanism (12);

a burner (18) having a nozzle (21) at its tip portion and an air-intake opening (20) at its intermediate portion where air is mixed with vaporized gas coming from the second valve mechanism (13);

a pipe (16) for connecting the second valve mechanism (13) with the burner (18);

the first valve mechanism (12) including:

a first valve body (22) having a cylindrical inner wall, a female thread formed in the cylindrical inner wall and a valve seat formed in the first valve body (22);

an actuating member (23) having a male thread screwed with the female thread of the first valve body (22) with a small gap for gas flow;

a disc (25) positioned downstream of the male thread of the actuating member (23);

the disc (25) being set to be moved by the inner end of the actuating member (23) along the cylindrical inner wall in the first valve body (22) in its longitudinal direction with a small gap between the periphery of the disc and the cylindrical inner wall of the first valve body (22) so that the gas can flow through the gap; and a resilient O-ring (24) disposed between the valve seat and the disc (25) and positioned downstream of the disc (25);

the O-ring (24) being designed such that the gas flowing from an entrance of the first valve mechanism (12) can be controlled by the O-ring (24) in cooperation with the disc (25) and the valve seat in such a manner that the gas can be completely vaporized downstream of the O-ring;

the actuating member (23) having a driven portion (23*a*) for turning the actuating member (23) in a desired direction;

a suction material (42) arranged through the entrance of the first valve mechanism (12) for feeding the gas from the tank (10) to the male thread of the actuating member (23);

the second valve mechanism (13) including:

a second valve body (32) having therein a passage formed form an entrance of the second valve mechanism (13) connected with the exit of the first valve mechanism (12) to an exit of the second valve mechanism (13) connected with the pipe (16), and a through-hole formed with a female thread; and a needle (31) having at its intermediate portion a male thread screwed with the female thread of the second valve body (32) for controlling the gas flowing through the passage;

a gas adjusting dial member (34) fixed to the needle (31) so that the needle (31) can be turned to move forwards or backwards when the gas adjusting dial member (34) is turned;

a piezo-electric unit (53) having an ignition button (53*a*);

an ignition plug (52) placed near the nozzle (21) and electrically connected to the piezo-electric unit (53);

means (46) for regulating air to be introduced into the air-intake opening (20);

an air control lever (47) for actuating the regulating means (46); and a casing (60) housing therein at least partly the tank (10), the first valve mechanism (12), the second valve mechanism (13), the pipe (16), the piezo-electric unit (53), the burner (18) and the air control lever (47), and having a gripped portion (60*a*) adapted to be gripped by hands;

the gas adjusting dial member (34), the air control lever (47) and the ignition button (53*a*) being arranged near the gripped portion (60*a*) of the casing (60);

the nozzle (21) being inclined outwardly at an angle between 30 degree and 75 degree in respect of the longitudinal direction of the torch.

2. The handy torch of claim 1, wherein the burner (18) is positioned at one end of the casing (60), the gripped portion (60*a*) being positioned at the other end thereof, the gas adjusting dial member (34) being positioned adjacent to the inner end of the gripped portion (60*a*) of the casing (60), the ignition button (53) and the air control lever (47) being positioned between the gas adjusting dial member (34) and the burner (18).

3. The handy torch of claim 1, wherein the driven portion (23*a*) of the actuating member (23) is positioned at the side of the casing (60) opposing to the other side thereof at which the gas adjusting member (34) is positioned.

4. The handy torch of claim 1 or 3, wherein the driven portion (23*a*) is a groove formed in the outer end of the actuating member (23).

5. The handy torch of claim 1, wherein a valve (41) for filling gas is positioned at the end portion of the casing (60) opposing to the other end portion thereof at which the burner (18) is positioned.

6. The handy torch of claim 1, wherein the gripped portion (60*a*) is formed rectangular in cross-section.

7. The handy torch of claim 1, wherein the O-ring has a hardness between 40 and 60 of Shore A.

8. The handy torch of claim 1, wherein the O-ring is made of rubber.

* * * * *